US007789678B2

(12) United States Patent
Nagata et al.

(10) Patent No.: US 7,789,678 B2
(45) Date of Patent: Sep. 7, 2010

(54) MULTIPOLAR CONNECTOR AND PORTABLE RADIO TERMINAL OR SMALL-SIZED ELECTRONIC DEVICE USING MULTIPOLAR CONNECTOR

(75) Inventors: Takayuki Nagata, Yao (JP); Hayato Kondo, Yao (JP)

(73) Assignee: Hosiden Corporation, Yao-shi (JP)

( * ) Notice: Subject to any disclaimer, the term of this patent is extended or adjusted under 35 U.S.C. 154(b) by 110 days.

(21) Appl. No.: 11/655,909

(22) Filed: Jan. 22, 2007

(65) Prior Publication Data

US 2007/0173116 A1 Jul. 26, 2007

(30) Foreign Application Priority Data

Jan. 23, 2006 (JP) ..... 2006-014349

(51) Int. Cl.
*H01R 4/66* (2006.01)
*H01R 13/648* (2006.01)

(52) U.S. Cl. ..... 439/108; 439/607.05; 439/941

(58) Field of Classification Search ..... 439/607, 439/608, 101, 108, 74, 607.05, 607.41, 607.49, 439/941

See application file for complete search history.

(56) References Cited

U.S. PATENT DOCUMENTS 4,687,267 A * 8/1987 Header et al. ..... 439/607
5,507,655 A * 4/1996 Goerlich ..... 439/108
6,190,206 B1 * 2/2001 Yang ..... 439/608
6,250,935 B1 6/2001 Mochizuki et al. ..... 439/74
6,764,315 B2 * 7/2004 Ng et al. ..... 439/66

FOREIGN PATENT DOCUMENTS

JP 2000-331731 11/2000
JP 2005-71669 3/2005
JP 2005-116447 4/2005

OTHER PUBLICATIONS

Chinese Office Action mailed Mar. 25, 2010 with English translation (8 pages).

* cited by examiner

*Primary Examiner*—Felix O Figueroa
(74) *Attorney, Agent, or Firm*—Kratz, Quintos & Hanson, LLP

(57) ABSTRACT

A plurality of contacts are assembled at prescribed spacings in a longitudinal direction of a receptacle body. Each contact has a meandering curved part in the intermediate portion for elastically contacting the corresponding contact. A ground member extending in a longitudinal direction of the receptacle body and passes through the inner area of the respective meandering curved parts of the contacts is combined with the receptacle body. The ground member is arranged at a position equally distant from the respective parts of the meandering curved part.

15 Claims, 4 Drawing Sheets

MULTIPOLAR CONNECTOR AND PORTABLE RADIO TERMINAL OR SMALL-SIZED ELECTRONIC DEVICE USING MULTIPOLAR CONNECTOR

The present application claims priority under 35 U.S.C. §119 of Japanese Patent Application No. 2006-014349 filed on Jan. 23, 2006, the disclosure of which is expressly incorporated by reference herein in its entity.

BACKGROUND OF THE INVENTION

1. Field of the Invention

The present invention relates to a connector used in a portable radio terminal such as a mobile telephone and a small-sized electronic device such as a laptop PC, or the like. In more detail, the present invention relates to a multipolar connector in which a plurality of contacts are assembled at prescribed spacings in a longitudinal direction of a laterally long body, and a portable radio terminal or a small-sized electronic device using such multipolar connector.

2. Description of the Related Art

In a mobile telephone or a laptop PC, a connector of a multipolar circuit board mounting type is used to connect cables connected to a liquid crystal display device or the like to a circuit board on a motherboard. A connector of this type is composed of a laterally long connector plug in which a plurality of cables are assembled, and a laterally long receptacle of a circuit board mounting type to which the connector plug is fitted, as described, for example, Japanese Laid-Open Patent Application No. 2000-331731, Japanese Laid-Open Patent Application No. 2005-71669 and Japanese Laid-Open Patent Application No. 2005-116447.

Generally, a laterally long connector plug is formed in a cap-type which covers a laterally long receptacle, and has a number of plug contacts aligned at prescribed spacings in a longitudinal direction (lateral width direction). The plug contacts are electrically connected to a number of cables assembled. On the other hand, the receptacle has a number of receptacle contacts aligned at prescribed spacings in a longitudinal direction (lateral width direction) so as to correspond to the plug contacts. The receptacle contacts are inserted in slit-shaped insertion parts that are arranged orthogonally to the longitudinal direction and formed at prescribed spacings in a longitudinal direction of a laterally long plastics material body. One end part of each receptacle contact is a contact part which press-contacts the corresponding plug contact. The other end part is a circuit board mounting part, which is to be joined to the wiring pattern formed on the surface of a circuit board by soldering or the like.

Generally, in order to secure elastic contact with the plug contact, a meandering curved part as an elastic deformation part is provided between the contact part and the circuit board mounting part.

By attaching the connector plug to the receptacle mounted on the surface of the circuit board, respective meandering curved parts and the like of the receptacle contacts in the receptacle elastically deform, and with the repulsions thereof, the receptacle contacts press-contact the corresponding plug contacts in the connector plug. Thereby, the cables assembled to the connector plug are electrically connected to the wiring pattern formed on the surface of the circuit board.

In such a connector of the multipolar circuit board mounting type, the both end parts of the receptacle body, that is, the both sides of the receptacle contact group are provided with ground terminals also serving as mounting terminals for securing joining strength with the circuit board of the receptacle and shielding and the like. However, since a number of receptacle contacts are arranged between the ground terminals on the both ends, distances from contacts to ground terminals differ depending on the arranged positions of the receptacle contacts. That is, contacts arranged toward opposite ends of the body are closer to the ground terminal, and for contacts positioned closer to the center part while separated from the ends, distances to the ground terminal increase. As a result, impedance characteristics differ between contacts, causing the following problems.

For performing high-speed digital signal processing, impedance characteristics must be consistent in the connector passing area. In performing differential transmission, as the skew (difference in electric lengths) between two lines increases, transmission characteristics of differential transmission paths decline. Further, in the case of transmitting electric signals through a plurality of differential lines, if the skew increases between differential pairs, there is a risk that more errors may be caused in the processing on the reception side. In the case of the conventional structure described above, a difference in impedance characteristics is caused between contacts, so the skew becomes larger, whereby the skew between the differential pairs also becomes larger. Consequently, problems such as decline in transmission characteristics and an increase in errors on the reception side are caused.

In order to solve these problems, a conventional solution is to use contacts on the opposite ends of differential pairs in opposite poles as ground terminals so as to secure consistency in impedance characteristics between the opposite poles. However, the required number of contacts increases, so not only the number of components increases, but also the connector becomes enlarged in a longitudinal direction (contact aligning direction).

In addition, in high-speed digital signal processing, circuit board wiring, cable wiring and connector wiring are not mere connection lines, but they must be considered as signal transmission paths, so it is required to give consideration to making the positional relationship between the signal transmission paths and the ground constant. Namely, not only in a contact alignment direction but also in a direction orthogonal to the contact alignment direction, it is necessary to keep the positional relationships between the contacts and the ground constant, and to uniform the impedance characteristics.

However, in the conventional receptacle of a circuit board mounting type, in order to secure elastic contact with a corresponding contact on the plug side, a meandering curved part is often provided in the intermediate portion of the receptacle contact, as described above. Consequently, the positional relationship with the ground largely changes in the meandering curved part. This also causes a problem due to inconsistency in the impedance characteristics.

SUMMARY OF THE INVENTION

The present invention has been invented in view of above circumstances. It is an object of the present invention to provide a multipolar connector capable of ensuring consistency in impedance characteristics in a contact alignment direction even in the case of large number of contacts, and a portable radio terminal or a small-sized electronic device using such multipolar connector.

Another object of the present invention is to provide a multipolar connector capable of, although a meandering curved part as an elastic deformation part is provided in the intermediate portion of a contact, maintaining as constant a positional relationship as possible between the contact and the ground, particularly in this part, and ensuring consistency in the impedance characteristics in a direction orthogonal to the contact alignment direction.

In order to achieve the objects, a multipolar connector according to the present invention is a multipolar connector in which a plurality of contacts are assembled at prescribed spacings in a longitudinal direction of a laterally long body, and each contact is provided in the intermediate portion with a meandering curved part serving as an elastic deformation part for elastically contacting the counterpart contact. The multipolar connector includes a ground member extending in the longitudinal direction of the body and passing through the inner area of the meandering curved parts of the contacts.

In the multipolar connector according to the present invention, because the ground member extending in the longitudinal direction of the body is provided through the inner area of the meandering curved parts of the contacts, the positional relationships between the contacts and the ground are constant in the contact alignment direction, so impedance characteristics are matched between the contacts. Further, positional relationships between the contacts and the ground are equalized in the respective meandering curved parts of the contacts, so the impedance characteristics are matched even in a direction orthogonal to the contact alignment direction.

It is desirable that the ground member has the same positional relationship with respect to the meandering curved part in each contact from the viewpoint of increasing the consistency in impedance between the contacts. Further, from the viewpoint of equalizing the positional relationships between the contacts and the ground in the meandering curved parts, it is preferable that the ground member is located at the almost center part inside the meandering curved part of each contact. Specifically, if the meandering curved part of each contact is in an almost inverted U shape in which three rectilinear parts are linked at almost right angles, it is preferable that when each contact contacts the counterpart contact and its meandering curved part is thereby elastically deformed, the ground member is located at a position almost equally distant from the three rectilinear parts.

It is preferable that the ground member be assembled in the body by insert moldering. Such assembly may obviate the need for providing grooves or the like and thus may prevent, for example, warpage of the body due to the strength reduction. The assembly also enables to make the body thinner so as to cause the ground member and the contacts to be closer, which increases the freedom relating to the arranging position of the ground member.

The multipolar connector according to the present invention is preferable as a circuit board mounting type, and in particular, the structure thereof is preferable for a receptacle to be combined with a connector plug.

In the multipolar connector according to the present invention, it is the main purpose to ensure consistency in the impedance characteristics for the meandering curved parts of the contacts. However, because the meandering curved part is commonly formed in the intermediate portion between a contact part formed at one end of a contact and a circuit board mounting part formed at the other end, and for at least a portion of the part exclusive of the meandering curved part in the intermediate portion, it is preferable to configure such that a distance to the circuit board below becomes almost equal to a distance from the meandering curved part to the ground member. Such configuration will further improve the consistency in the impedance characteristics in a direction orthogonal to the contact alignment direction.

Further, in the case of a multipolar connector in which a receptacle and a connector plug are combined, the connector plug commonly has plug contacts, corresponding to a plurality of receptacle contacts in the body, and a shield member covering the body, and each plug contact has a first contact part at one end part which contacts a receptacle contact, and a second contact part at the other end part to be connected with a cable.

For each plug contact, it is preferable to take measures for impedance. Specifically, it is preferable that each plug contact be configured such that respective distances from the first contact part and from the second contact part to the shield member are almost equal to a distance from the meandering curved part in the receptacle contact to the ground member, and it is more preferable that at least a portion of the part linking the first contact part and the second contact part be configured such that the distance to the shield member is almost equal to the distance from the meandering curved part in the receptacle contact to the ground member. Such configuration further improves the consistency in the impedance characteristics in the direction orthogonal to the contact alignment direction.

The multipolar connector according to the present invention includes a ground member extending in a longitudinal direction of the body and passing through the inner area of the respective meandering curved parts of a plurality of contacts, whereby even in the case of a large number of contacts, it is possible to provide the constant positional relationships between the respective contacts and the ground, and to ensure consistency in the impedance characteristics between the contacts, more particularly, in a contact alignment direction. Further, since each contact has a meandering curved part, a contact state with the corresponding contact is fine. In spite of the fact, the positioning relationships between the contact and the ground in the meandering curved parts are equalized, so it is possible to match impedance characteristics in a direction orthogonal to the contact alignment direction. Through these two impedance controls, various problems caused due to inconsistency in the impedance characteristics are solved, which contributes to stable transmission of high-speed digital signals. Further, the multipolar connector according to the present invention also provides such effects that the body is strengthened by the ground member, and enlargement of the body is prevented since the ground member is disposed inside the meandering curved parts.

By using the multipolar connector according to the present invention having such characteristics to a mobile radio terminal or a small-sized electronic device, such a device becomes one which is excellent in transmission characteristics of high-speed digital signals and also excellent in economy and reliability.

DETAILED DESCRIPTION OF THE PREFERRED EMBODIMENTS

Figure 1:
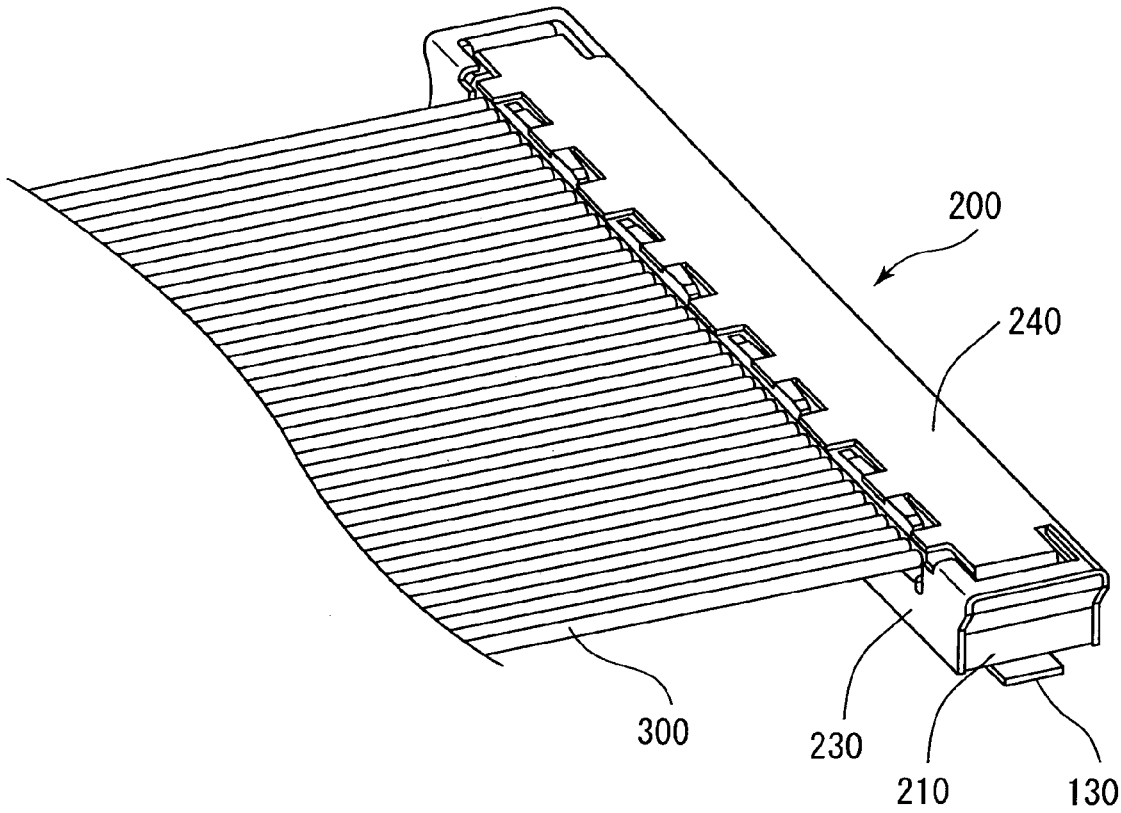
FIG. 1 is a perspective view of a multipolar connector showing an embodiment of the present invention.
Figure 2:
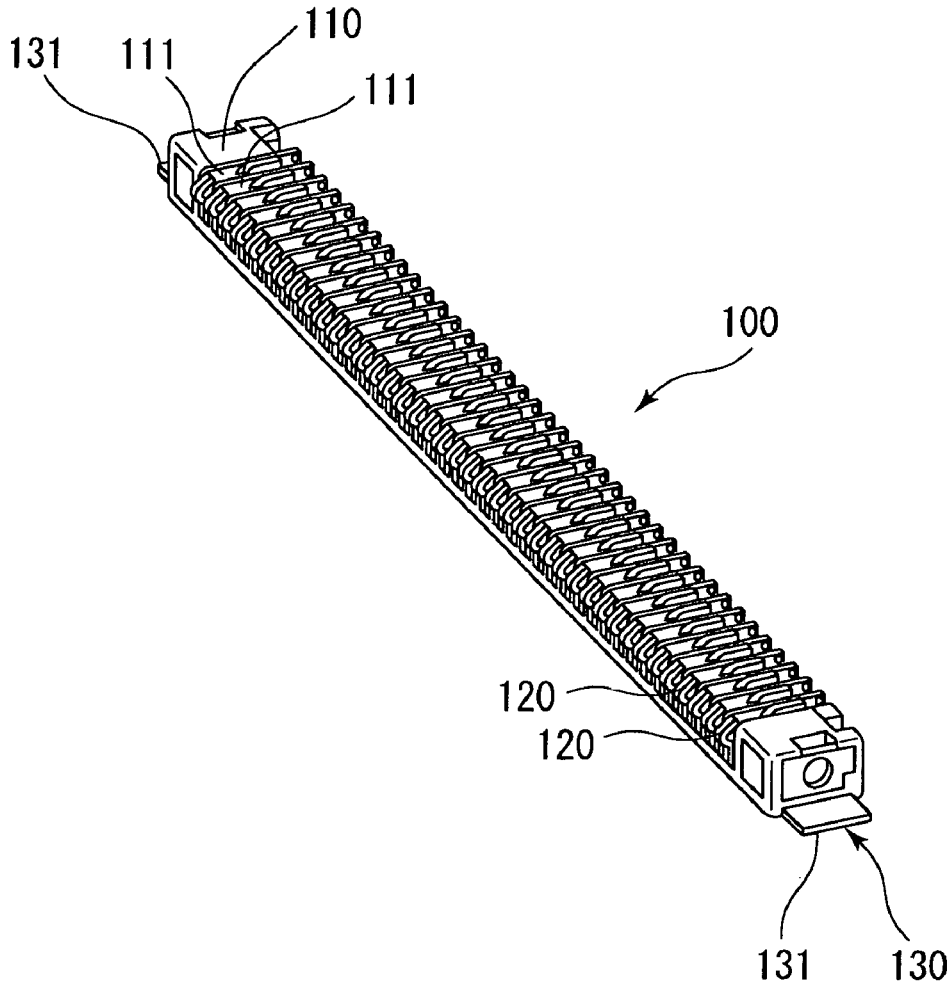
FIG. 2 is a perspective view of a receptacle of the multipolar connector.
Figure 3:
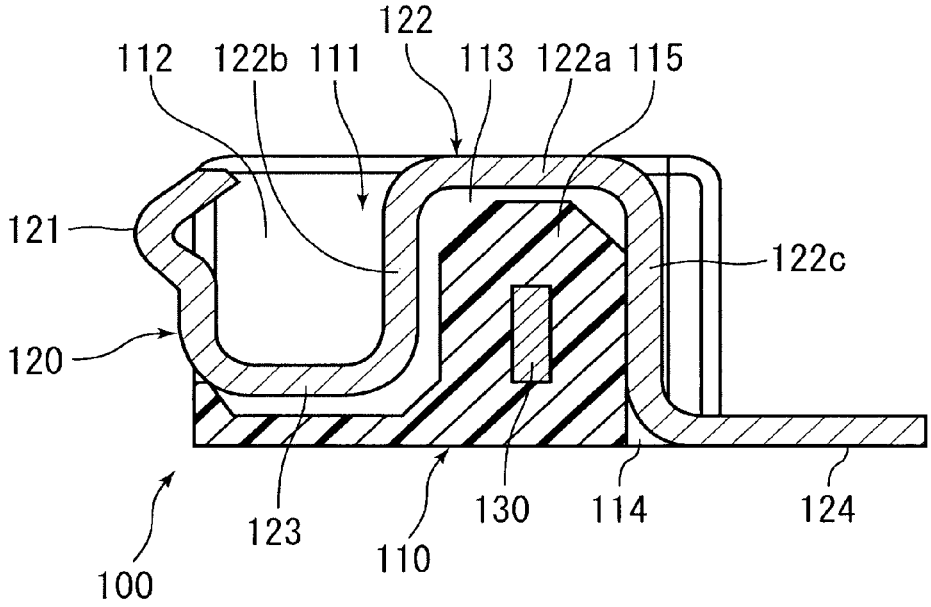
FIG. 3 is a cross-sectional side view of the receptacle.
Figure 4:
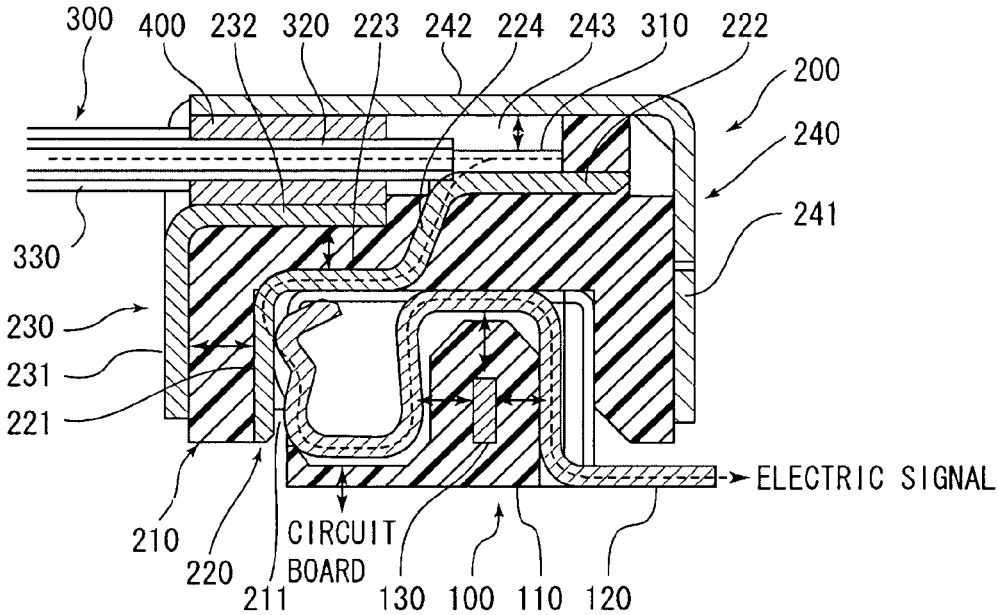
FIG. 4 is a cross-sectional side view of a multipolar connector in which the receptacle and a plug are combined.

Hereinafter, an embodiment of the present invention will be described based on the drawings. FIG. 1 is a perspective view of a multipolar connector, showing an embodiment of the present invention, FIG. 2 is a perspective view of a receptacle of the connector, FIG. 3 is a cross-sectional side view of the receptacle, and FIG. 4 is a cross-sectional side view of a state where the receptacle is combined with a plug.

A multipolar connector according to the present embodiment is a connector of a circuit board mounting type used for, for example, connecting between a liquid crystal display and a circuit board on a motherboard in a mobile telephone or a laptop PC. The connector is formed of a laterally long receptacle 100 to be mounted on the surface of a circuit board, and a laterally long connector plug 200 to be attached thereto. In the connector plug 200, a plurality of coaxial cables 300 aligned laterally are inserted from the front side and connected.

The receptacle 100 mounted on the surface of a circuit board includes a laterally long receptacle body 110 made of plastics material, and a number of receptacle contacts 120 held by it, and a laterally long ground member 130 buried over the whole longitudinal length in the receptacle body 110.

The receptacle body 110 is a laterally long rectangular parallelepiped having a number of contact insertion parts 111 formed at prescribed spacings in a longitudinal direction. The contact insertion parts 111 are slit-shaped recesses orthogonal to the longitudinal direction of the body 110, and are provided in the body 110 excepting the both lengthwise end parts and the widthwise center part. Each insertion part 111 consists of a deep recess 112 on the front side, and a shallow part 113 of the rear side formed above the protruded part 115 of the body 110, and a penetration part 114 of the further rear side. The recess 111 of the front side opens to the front side so as to protrude the receptacle contact 120.

The receptacle contact 120 is formed of an almost vertical contact part 121 on the front side, a meandering curved part 122 protruded upward and disposed at the rear side of the contact part 121, a horizontal connection part 123 linking them, and a circuit board mounting part 124 formed continuously on the rear side of the meandering curved part 122. The contact part 121 is bent in a protruding "L" shape to the front side and thereby protrudes toward the front side of the insertion part 111 in order to improve the contacting property with the corresponding contact of the plug 200.

The meandering curved part 122 is an angularly curved part in an inverse U-shape, consisting of a horizontal part 122*a* and a pair of vertical parts 122*b* and 122*c* extending downward from the opposite ends of the horizontal part 122*a*, and is inserted in the insertion part 111 so as to cover the protruded part 115 of the body 110. Thereby, the front side vertical part 122*b*, together with the horizontal connection part 123 linking the lower end part thereof and the lower end part of the connection part 121, fits in the deep recess 112 of the insertion part 111, and the horizontal part 122*a* is fitted in the shallow part 113 above the protruded part 115. Further, the rear side vertical part 122*c* fits in the penetration part 114.

The circuit board mounting part 124 protrudes from the lower end part of the vertical part 122*c* to the rear side, and further, protrudes from the body 110 to the rear side so as to be connected with the circuit board. The lower face of the circuit board mounting part 124 is at the same level as the lower face of the body 110.

The laterally long ground member 130, made of a plate-shaped conductive material such as a copper plate, is buried in and longitudinally passes through the body 110 by insert molding. The both end parts of the ground member 130 are protruded from the both end sides of the body 110 as mounting terminal parts 131 and 131. The buried part excluding the both end parts of the ground member 130 is arranged at a position penetrating the protruded part 115 of the body 110. In more detail, when each receptacle contact 120 contacts the counterpart contact (plug contact 220 of the connector plug 200) and its meandering curved part 122 covering the protruded part 115 is thereby elastically deformed, the ground member 130 is arranged so as to be positioned at the center part of the protruded part 115 equally distant from the three parts of the meandering curved part 122, that is, the horizontal part 122*a* and the vertical parts 122*b* and 122*c*.

The mounting terminal parts 131 and 131 on the both ends are positioned at the same level as the bottom face of the body 110 for mounting on the surface of the circuit board, as in the circuit board mounting part 124 of the receptacle contact 120.

The connector plug 200 is a laterally long cap which covers, from the upper side, the receptacle 100 mounted on the surface of the circuit board. The connector plug 200 includes a laterally long plug body 210 made of plastics material, a number of plug contacts 220 combined by insert moldering in the plug body 210, a first shield member 230 combined with the plug body 210 by insert moldering together with the plug contacts 220, and a second shield member 240 combined with the plug body 210 by fitting. The both shield members 230 and 240 may be made of aluminum plate.

The plug body 210 has a laterally long receptacle fitting part 211 to which the receptacle 100 is fitted, on the lower face. A number of plug contacts 220 are aligned at prescribed spacings in a longitudinal direction of the body 210, corresponding to the receptacle contacts 120.

Each plug contact 220 has, at one end, a vertical first contact part 221 exposed to an inner wall face (the inner wall face of the front side facing the front of the receptacle body 110) of the fitting part 211 so as to contact the contact part 121 of the receptacle contact 120. The other end of each plug contact 220 is a horizontal second contact part 222 exposed toward the rear side of the top face of the body 210 for connecting with a core wire 310 of each coaxial cable 300. The vertical first contact part 221 is connected to the horizontal contact point 222 located above via the horizontal connection part 223 exposed on the ceiling face of the fitting part 211 and the inclined connection part 224 extending in an inclined manner from the tip to the rear side, and the inclined connection part 224 is completely buried in the plug body 210.

The first shield member 230 is a shield case, having an inverse L-shaped cross section covering the front face and the top face of the front side of the body 210, formed of the vertical face part 231 exposed to the front face of the body 210 and a horizontal face part 232 exposed to the top face of the front face side of the body 210.

The second shield member 240 is a shield cover having an inverse L-shaped cross section covering the rear face of the plug body 210 and the whole top face of the plug body 210. The member 240 is formed of a vertical face part 241 to contact the rear face of the plug body 210, and a horizontal face part 242 extending horizontally from the top end part of the vertical face part 241 to the front face side. The horizontal face part 242 constitutes a cable accommodation part 243 between it and the upper face of the plug body 210, into which a coaxial cable 300 is inserted.

Each of the coaxial cables 300 is inserted into a cable accommodation part 243 in a state where a coating cover 330 thereof is removed and a ground wire 320 is exposed. At the tip part of the inserted part, the core wire 310 is exposed. Then, the exposed ground wires 320 in the inserted parts are soldered collectively with the horizontal face part 232 of the first shield member 230 and the horizontally face part 242 of the second shield member 240 by a collective soldering part 400 to thereby form a ground bar. The exposed core wire 310 at the tip part is joined by soldering to the second contact part 222 of the corresponding plug contact 220.

Next, a using method and functions of the multipolar connector according to the present embodiment will be described.

The receptacle 100 is mounted on the surface of a circuit board. Specifically, respective circuit board mounting parts 124 of a number of receptacle contacts 120 are joined to the corresponding pattern on the surface of the circuit board by soldering. Together with it, the mounting terminal parts 131 and 131 on the both ends of the ground member 130 penetrating the receptacle body 110 in a longitudinal direction are joined to the ground pattern on the surface of the circuit board by soldering. Besides the respective circuit board mounting parts 124 of the receptacle contacts 120, the both mounting terminal parts 131 and 131 of the ground member 130 are joined to the surface of the circuit board, whereby excellent joining strength is secured. Further, because the both mounting terminal parts 131 and 131 are integral parts of the ground member 130, being a single member, an increase in the number of components can be avoided.

Further, the ground member 130 is insert-molded in the receptacle body 110, so it is not necessary to attach the mounting terminal parts 131 and 131 to the receptacle body 110 in the assembling process of the receptacle 100. In the assembling step of the receptacle 100, only receptacle contacts 120 are attached. Thereby, assembling of the receptacle 100 can be completed in one step, so it is possible to prevent time loss and deformation of components due to transference between steps, which are problems in the case of two steps.

In assembling a device, the connector plug 200 to which the coaxial cables 300 are connected is attached to the receptacle 100 mounted on the surface of the circuit board. Specifically, the connector plug 200 is put on the receptacle 100 such that the receptacle 100 is fitted to the receptacle fitting part 211 formed on the body lower face of the connector plug 200.

When the connector plug 200 is attached to the receptacle 100, each contact point 121 of a number of receptacle contacts 120 in the receptacle 100 press-contacts the first contact part 221 of the corresponding plug contact 220 in the connector plug 200. At this time, in the receptacle contact 120, the meandering curved part 122 in an almost inverted U shape, which is an elastic deformation part, elastically deforms together with the contact part 121. With the repulsion thereof, a secure electric contact can be obtained.

Through the electric contact, the core wire 310 of the coaxial cable 300 is electrically connected with the corresponding pattern on the circuit board via the plug contact 220 and the receptacle contact 120. Further, respective ground wires 320 of a plurality of coaxial cables 300, parallel to each other, are electrically connected with the first shield member 230 (shield case) and the second shield member 240 (shield cover) covering the plug 200 via the collective solder part 400.

Now, if paying attention to the receptacle contacts 120 assembled in the receptacle body 110, the ground member 130 penetrates the body 110 in a longitudinal direction, that is, in an alignment direction of the receptacle contact 120. Therefore, all receptacle contacts 120 have the same positional relationship to the ground, so impedance characteristics in a contact alignment direction are consistent.

Further, the ground member 130 penetrates the center part of the protruded part 115 of the body 110 to be covered by the meandering curved part 122 of each receptacle contact 120. In more detail, when each receptacle contact 120 contacts the plug contact 220 and its meandering curved part 122 in an almost inverted U shape is thereby elastically deformed, the ground member 130 is arranged at a position equally distant from three parts, that is, the horizontal part 122*a* and the vertical parts 122*b* and 122*c*, constituting the meandering curved part 122. The meandering curved part 122 in an almost inverted U shape is a part important for elastic contact of the receptacle contact 120, but the contact 120 is inevitably separated from the circuit board below at this part.

In transmitting high-speed digital signals, the receptacle contacts 120 constitute signal transmission lines together with the plug contacts 220. Namely, they are not mere connection lines, but serve as signal transmission lines. Therefore, it is desirable that respective parts of the receptacle contact 120 have constant positional relationships from the ground. However, at the part of the meandering curved part 122, the receptacle contact 120 is separated from the circuit board below, causing the positional relationship with the ground to be collapsed partially. When each receptacle contact 120 contacts the plug contact 220 and its meandering curved part 122 is thereby elastically deformed, the ground member 130 is arranged at a position equally distant from the three parts, that is, the horizontal part 122*a* and the vertical parts 122*b* and 122*c*, constituting the meandering curved part 122. Therefore, the positional relationship between the receptacle contact 120 and the ground can be kept constant even in the part of the meandering curved part 122 which is largely deformed. Consequently, for the receptacle contacts 120, the impedance characteristics can be consistent not only in their alignment direction but also in a direction orthogonal to the alignment direction. More specifically, inconsistency in the impedance characteristics in a direction orthogonal to the contact alignment direction, caused by the meandering curved part 122 in each receptacle contact 120, can be solved.

In addition, in the multipolar connector according to the present embodiment, the distance from the horizontal connection part 123, linking the contact part 121 of the front side of the receptacle contact 120 and the meandering curved part 122, to the parallel circuit board below is set to be almost equal to the distance from the meandering curved part 122 to the ground member 130. Further, the distance from the vertical first contact part 221 of the plug contact 220, to which the contact part 121 elastically contacts, to the vertical face part 231 of the first shield member 230 arranged in parallel on the front face side thereof is also set to be almost equal to the distance from the meandering curved part 122 to the ground member 130.

Namely, in each receptacle contact 120, the positional relationship with the ground can be held constant in not only the part of the meandering curved part 122, but also in every part excepting the circuit board mounting part 124 to be joined to the circuit board, so consistent impedance characteristics are ensured. Therefore, transmission characteristics in the receptacle contact 120 are excellent.

Further, when paying attention to the contact 220 on the plug 200 side, the distance from the first contact part 221 to the vertical face part 231 of the first shield member 230 arranged in parallel on the front face side thereof is set to be almost equal to the distance from the meandering curved part 122 to the ground member 130, as described above. Further, for the horizontal second contact part 222 to be connected with the core wire 310 of the coaxial cable 300, the distance to the horizontal face part 242 of the second shield member 240 arranged in parallel above is set to be almost equal to the distance from the meandering curved part 122 to the ground member 130. Moreover, for the horizontal connection part 223 linking the first contact part 221 and the second contact part 222, the distance to the horizontal face part 232 of the first shield member 230 arranged in parallel above is set to be almost equal to the distance from the meandering curved part 122 to the ground member 130.

In other words, each plug contact 220 has a constant positional relationship with the shield member (ground) in every part excepting the inclined connection part 224, whereby consistent impedance characteristics are secured. Therefore, transmission characteristics are excellent not only in the receptacle contact 120 but also in the plug contact 220. Note that the first shield member 230 and the second shield member 240 are grounded via the ground member 130 of the receptacle 100 side associating with attachment of the plug 200 to the receptacle 100.

Although the receptacle contacts 120 are aligned in a row facing the same direction in the embodiment above, they may be aligned in two rows where contact points 121 face each other. The aligning mode and respective shapes of the receptacle contacts 120 and the plug contacts 220 are not limited to those described in the above embodiment.

What is claimed is:

1. A multipolar connector comprising:

a plurality of contacts assembled at prescribed spacings in a longitudinal direction of a laterally long body of the connector, each of the contacts is provided in an intermediate portion thereof with a meandering curved part in an almost inverted U shape being arranged to be elastically deformed when the each contact contacts a counterpart contact of a counterpart connector; and a ground member extending in the longitudinal direction of the body and passing through almost center parts of inner areas of the respective meandering curved parts of the plurality of the contacts, wherein the ground member in its entirety is of rectangular shape in cross-sectional view taken perpendicular to the longitudinal direction of the body, wherein the meandering curved part in each contact includes three rectilinear parts linked at almost right angles, the three rectilinear parts defining said inner area, and when each contact contacts said counterpart contact and the meandering curved part is thereby elastically deformed, the ground member is located at a position almost equally distant from the three rectilinear parts, and wherein the ground member is a conductive plate body of rectangular shape in cross-sectional view and has a first face, a second face opposite the first face, and a third face perpendicular to the first and second faces, in each of the contacts, the three rectilinear parts of the meandering curved part include a first rectilinear part, a second rectilinear part, and a third rectilinear part linked to the first and second rectilinear parts at right angles, and when the each contact contacts said counterpart contact and the meandering curved part is thereby elastically deformed, a distance between the first rectilinear part and the first face, a distance between the second rectilinear part and the second face, and a distance between the third rectilinear part and the third face is almost the same.

2. A multipolar connector comprising:

a plurality of contacts assembled at prescribed spacings in a longitudinal direction of a laterally long body of the connector, each of the contacts is provided in an intermediate portion thereof with a meandering curved part in an almost inverted U shape in cross-sectional view taken perpendicular to the longitudinal direction of the body, each of the contacts being arranged to be elastically deformed when each of the contacts a counterpart contact of a counterpart connector; and a ground member extending in the longitudinal direction of the body and passing through almost center parts of inner areas of the respective meandering curved parts of the plurality of the contacts, wherein the ground member in its entirety is of rectangular shape in cross-sectional view taken perpendicular to the longitudinal direction of the body, wherein the meandering curved part in each of the contacts includes three rectilinear parts linked at almost right angles, the three rectilinear parts defining said inner area, and when each of the contacts contacts said counterpart contact and the meandering curved part is thereby elastically deformed, the ground member is located at a position almost equally distant from the three rectilinear parts.

3. The multipolar connector according to claim 2, wherein the ground member has a same positional relationship with any of the meandering curved parts of the contacts.

4. The multipolar connector for mounting on a circuit board according to claim 2, wherein each of the contacts comprises:

a contact part formed at one end part;

a circuit board mounting part formed at the other end part;

the meandering curved part formed in said intermediate portion between the contact part and the circuit board mounting part; and a part exclusive of the meandering curved part in the intermediate portion, and at least a portion of the part exclusive of the meandering curved part is so configured that a distance therefrom to the circuit board is almost equal to a distance from the meandering curved part to the ground member.

5. The multipolar connector according to claim 2, wherein the ground member is embedded in the body.

6. The multipolar connector according to claim 2, wherein the body is a receptacle body for mounting on a circuit board, and is adapted to be combined with a connector plug serving as said counterpart connector to cover the body.

7. A combination of a multipolar connector and a connector plug, including the multipolar connector according to claim 6, wherein the connector plug comprises:

a plurality of plug contacts being provided in a plug body and serving as said counterpart contacts of a plurality of receptacle contacts; and a shield member covering the plug body, each of the plug contacts comprises:

a first contact part formed at one end part for contacting a corresponding one of the receptacle contacts; and a second contact part formed at the other end part for making connection with a cable, and the first contact part and the second contact part are so configured that respective distances from the first contact part and from the second contact part to the shield member are almost equal to a distance from the meandering curved part to the ground member in the receptacle contact.

8. The combination according to claim 7, wherein at least a portion of a part linking the first contact part and the second contact part is so configured that a distance therefrom to the shield member is almost equal to said distance from the meandering curved part to the ground member in the receptacle contact.

9. A portable radio terminal or a small-sized electronic device using a multipolar connector according to claim 2.

10. A portable radio terminal or a small-sized electronic device using a multipolar connector according to claim 3.

11. A portable radio terminal or a small-sized electronic device using a multipolar connector according to claim 4.

12. A portable radio terminal or a small-sized electronic device using a multipolar connector according to claim 5.

13. A portable radio terminal or a small-sized electronic device using a multipolar connector according to claim 6.

14. A portable radio terminal or a small-sized electronic device using the combination according to claim 7.

15. A portable radio terminal or a small-sized electronic device using the combination according to claim 8.

* * * * *